US011337455B1

(12) United States Patent
Heiniemi

(10) Patent No.: US 11,337,455 B1
(45) Date of Patent: May 24, 2022

(54) JAR DEVICE

(71) Applicant: Jonathan Heiniemi, Nevada City, CA (US)

(72) Inventor: Jonathan Heiniemi, Nevada City, CA (US)

( * ) Notice: Subject to any disclaimer, the term of this patent is extended or adjusted under 35 U.S.C. 154(b) by 283 days.

(21) Appl. No.: 16/517,410

(22) Filed: Jul. 19, 2019

(51) Int. Cl.

| | |
|---|---|
| ***A24F 1/30*** | (2006.01) |
| ***B65D 23/00*** | (2006.01) |
| ***A24F 1/32*** | (2006.01) |
| ***B65D 43/02*** | (2006.01) |
| ***B65D 47/12*** | (2006.01) |
| ***B65D 1/10*** | (2006.01) |

(52) U.S. Cl.
CPC ..... *A24F 1/30* (2013.01); *A24F 1/32* (2013.01); *B65D 1/10* (2013.01); *B65D 23/00* (2013.01); *B65D 43/0231* (2013.01); *B65D 47/12* (2013.01)

(58) Field of Classification Search
CPC .. A24F 1/30; A24F 1/00; A24F 15/015; A24F 23/04; A24F 2700/03; A24F 1/32; B65D 23/00; B65D 39/005; B65D 39/0047; B65D 47/121; B65D 1/0238; B65D 2251/0015; B65D 2251/0025; B65D 2251/0071; B65D 2251/0096; B65D 21/086; B65D 51/228; B65D 11/188; B01L 6/569
See application file for complete search history.

(56) References Cited

U.S. PATENT DOCUMENTS

| | | | | |
|---|---|---|---|---|
| 285,597 | A * | 9/1883 | Eustis | B67C 11/02 141/343 |
| 3,863,646 | A * | 2/1975 | Kahler | A24F 1/30 131/173 |
| 7,861,900 | B2 * | 1/2011 | Ryan | B65D 25/24 222/482 |
| 2007/0079898 | A1 * | 4/2007 | Grover | B67C 11/02 141/340 |
| 2009/0107582 | A1 * | 4/2009 | Sayage | B65D 51/24 141/340 |
| 2014/0326256 | A1 * | 11/2014 | McKay | A24F 1/30 131/173 |
| 2015/0307231 | A1 * | 10/2015 | Diaz | A61J 9/003 220/614 |
| 2015/0374032 | A1 * | 12/2015 | De Gaglia | A24F 1/00 131/225 |
| 2018/0042296 | A1 * | 2/2018 | Isler | A24F 1/30 |
| 2018/0317546 | A1 * | 11/2018 | Rial | A24F 1/30 |
| 2018/0360107 | A1 * | 12/2018 | Gonzalez | A24F 1/02 |

FOREIGN PATENT DOCUMENTS

| | | | | |
|---|---|---|---|---|
| DE | 202013007850 | U1 * | 10/2013 | A24F 1/30 |

* cited by examiner

*Primary Examiner* — Anthony D Stashick
*Assistant Examiner* — Prince Pal
(74) *Attorney, Agent, or Firm* — Theodore J. Bielen, Jr.

(57) ABSTRACT

A jar device convertible into various configurations utilizing a container having a pair of threaded surfaces. A hollow body includes a wall that is capable of overlying the container and also includes a pair of threaded surfaces. The container threaded surfaces and hollow body threaded surfaces are capable of threadingly engaging one another.

12 Claims, 5 Drawing Sheets

JAR DEVICE

BACKGROUND OF THE INVENTION

The present application relates a novel and useful jar device.

Water pipes, or bongs, have been a favorite choice of smokers for over 2,000 years. Water pipes are used by smokers to filter and cool smoke from a burning herbal source before inhalation.

In the present, water pipes were typically constructed of glass and used a water chamber to effect the heretofore mentioned cooling and filtration. Recent innovations have provided water pipes with gas-dispersion frits that break up smoke entering the water pipe into fine bubbles to increase the water-contact area. Such frits are commonly referred to as a diffuser since they diffuse or disperse herbal smoke. Although water pipes are useful in producing smoke for inhalation, which is less harmful than unfiltered smoke, they are often bulky and difficult to transport and manipulate.

A water pipe device which is compact and transportable would be a notable advance in the field of smokers' articles.

SUMMARY OF THE INVENTION

In accordance with the present application, a novel and useful jar device, which may be used as a water pipe, is herein provided.

The jar device of the present application utilizes a container having a bottom and an extending wall to form a chamber. The wall terminates in a mouth. The container further includes a first threaded surface outside the chamber and a second threaded surface within the chamber. Both the first and second threaded surfaces are positioned adjacent the mouth of the container.

The jar device of the present application is also provided with a hollow body that includes a wall forming an open chamber. The open chamber includes first and second entryways. The hollow body is also formed with a first threaded surface which lies outside the open chamber and a second threaded surface which lies outside the open chamber. The first and second threaded surfaces are adjacent each other at the first entryway.

Moreover, the first threaded surface of the container is capable of threadingly engaging the second threaded surface of the hollow body. Likewise, the second threaded surface of the container is capable of threadingly engaging the first threaded surface of the hollow body. In this manner, the jar device of the present application may take dual configurations which are employed during use and storage of the same.

Finally, the jar device of the present application also includes a lid for covering the mouth of the container upon the threading engagement of the second threaded surface of the hollow body with the first threaded surface of the container.

The hollow body may also be formed such that the first entryway of the open chamber possesses a smaller transverse dimension than the second entryway to the open chamber. In this manner, a bell-shaped structure is created. In addition, the hollow body wall is capable of overlying the wall of the container. Such an arrangement allows the threading engagement of the second threaded surface of the hollow body with the first threaded surface of the container, allowing the jar device of the present application to be readily stored.

A spout may be formed in the container to allow communication of the ambient atmosphere with the chamber of the container.

It may be apparent that a novel and useful jar device has been heretofore described.

It is therefore an object of the present application to provide a jar device which may be converted to a water pipe by a simple assembly maneuver.

Another object of the present application is to provide a jar device which may be manipulated to create a storage configuration after use as a water pipe.

Another object of the present application is to provide a jar device that may be constructed of transparent material, such as glass or plastic.

Another object of the present application is to provide a jar device which is capable of being sealed by a lid or opened to create a smoking device, as desired.

Another object of the present application is to provide a jar device which is convertible into a smoking device or into a configuration for storage that is simple and efficiently carried out by the user.

Yet another object of the present application is to provide a jar device that is viewed as a novelty item.

The application possesses other objects and advantages, especially as concerns particular characteristics and features thereof which will become apparent as the specification continues.

For a better understanding of the application, reference is made to the following detailed description of the preferred embodiments thereof which should be referenced to the prior described drawings.

DETAILED DESCRIPTION OF THE PREFERRED EMBODIMENTS

Various aspects of the present application will evolve from the following detailed description of the preferred embodiments thereof which should be referenced of the prior described drawings.

Figure 6:
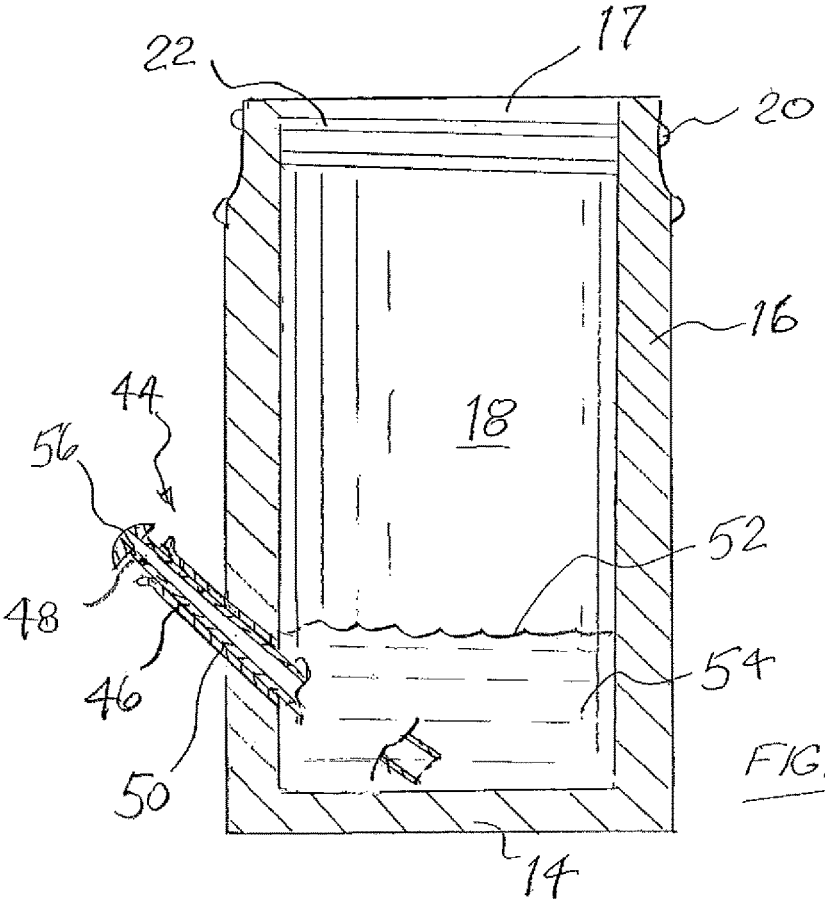
FIG. 6 is a sectional view taken along line 6-6 of FIG. 4.

The invention as a whole for a jar device is identified in the drawings by reference character 10, FIGS. 1, 2, 7, and 8. Jar device 10 includes as one of its elements a container 12. Container 12 is constructed with a bottom 14 and a wall 16 extending therefrom, terminating in a mouth 17. Bottom 14 and wall 16 form a chamber 18. Container 12 further includes a first threaded surface 20, which lies outside chamber 18, and a second threaded surface 22, which is located within chamber 18, FIG. 6.

Figure 1:
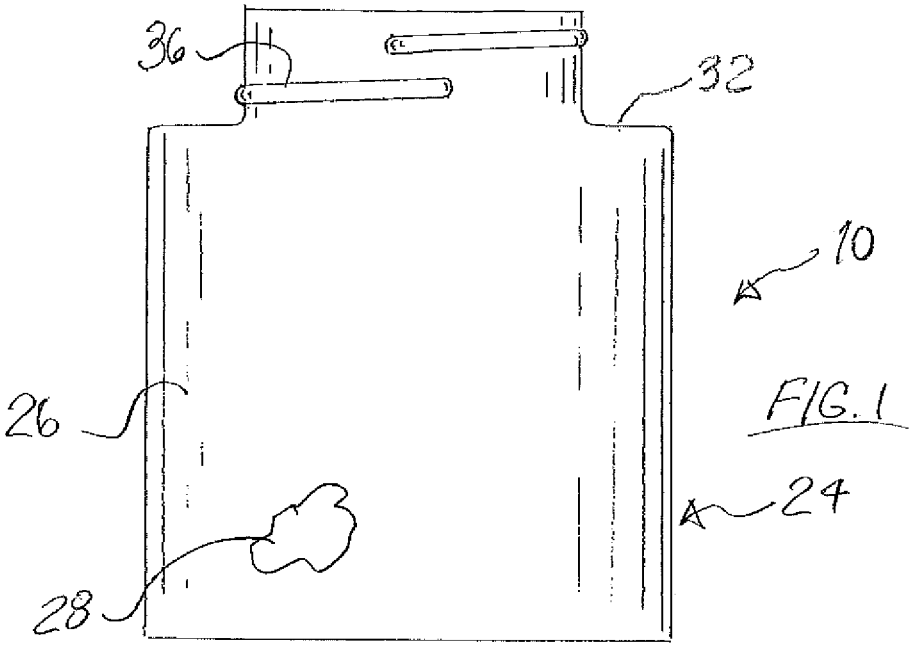
FIG. 1 is a side-elevational view of the hollow body portion of the jar device of the present application.
Figure 2:
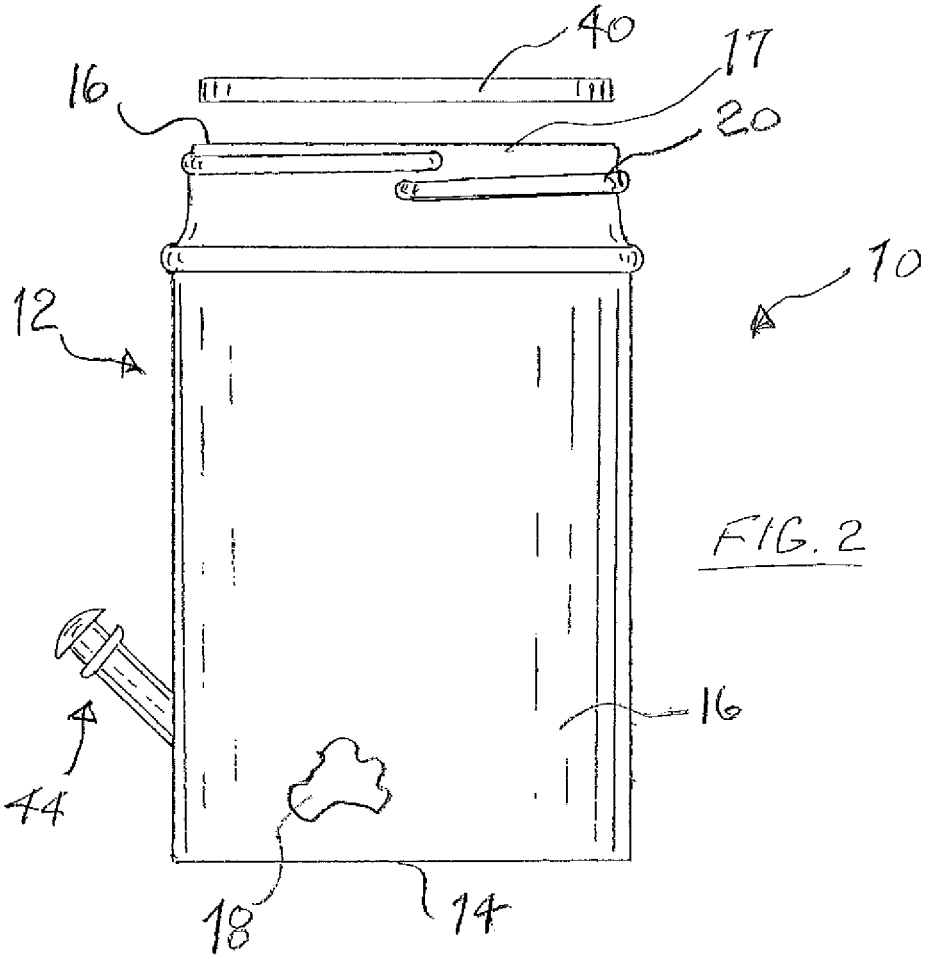
FIG. 2 is a side-elevational view of the container portion of the jar device of the present application.
Figure 3:
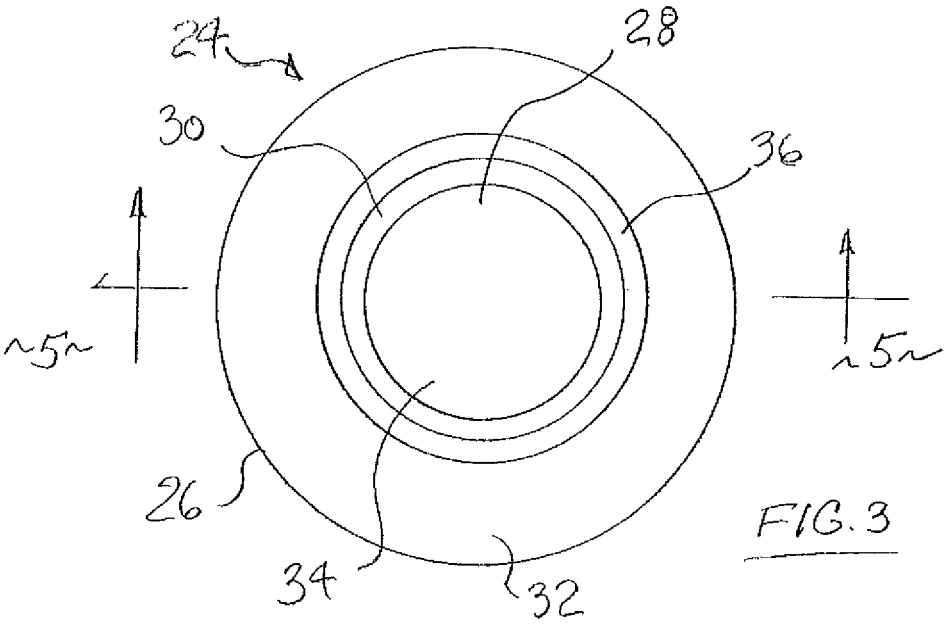
FIG. 3 is a top-plan view of FIG. 1.
Figure 4:
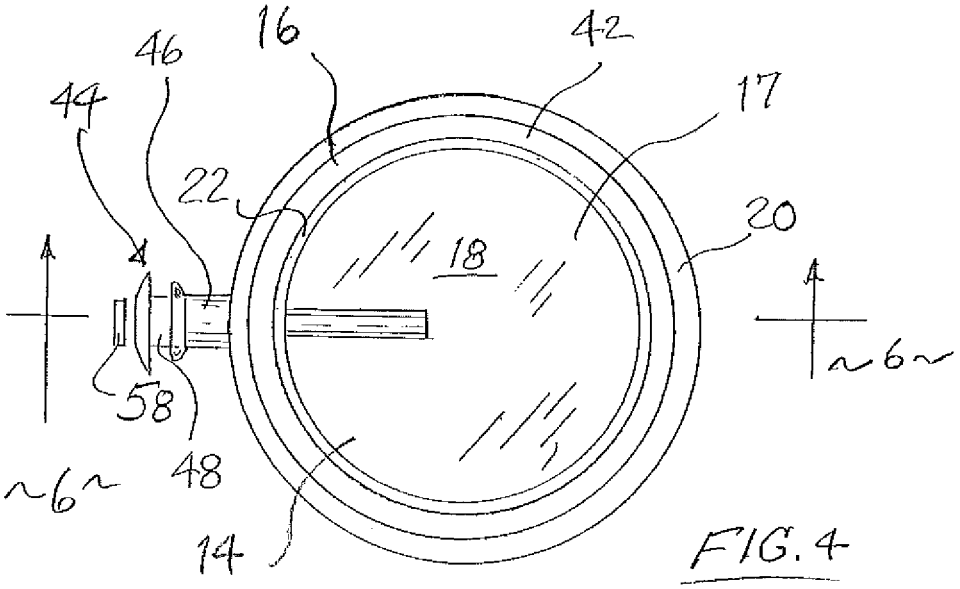
FIG. 4 is a top-plan view of FIG. 2.
Figure 5:
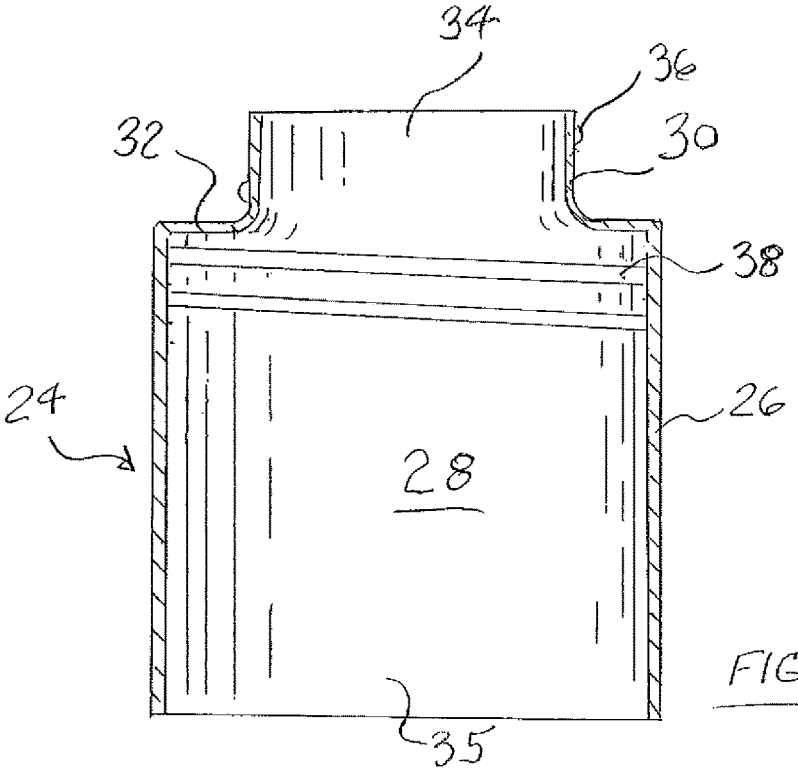
FIG. 5 is a sectional view taken along line 5-5 of FIG. 3.

Jar device 10 further comprises a hollow body or hood 24 formed by a wall portion 26 and creating an open chamber 28, FIGS. 1 and 5. Wall portion 26 of hollow body 24 is formed with a narrow end portion 30 and a shoulder 32. Further, wall portion 26 of hollow body 24 is fashioned with a first entryway 39 to open chamber 28 and a second entryway 15 to open chamber 28, FIG. 5. In addition, hollow body 24 possesses a first threaded surface 36, and a second threaded surface 38. First and second threaded surfaces 36 and 38 of hollow body 24 lie adjacent first entryway 34 to open chamber 28. In addition, it may be apparent from FIG. 5 that first threaded surface 36 of hollow body 24 lies outside open chamber 28 while second threaded surface 38 of hollow body 24 lies within open chamber 28. Needless to say, first threaded surface 20 of container 12 is capable of threadingly engaging second threaded surface 38 of hollow body 24. Likewise, second threaded surface 22 of container 12 is capable of threadingly engaging first threaded surface 36 of hollow body 24. A lid 40 may be rested upon the upper surface 42 of wall 16 of container 12. It should be realized that first entryway 34 of hollow body 24 possesses a smaller transverse dimension than the transverse dimension of second entryway 35 to chamber 28. In essence, hollow body 24 may be described as a bell-shaped member.

Again viewing FIGS. 2, 4, and 6-8, it may be observed that jar device 10 includes a spout 44. In the present embodiment, spout 44 is formed with a conduit 46 that permits communication with container chamber 18. In addition, an insert 48 is employed, which lies within passageway 50 of conduit 46. Insert 48 may extend into chamber 18 and lie beneath the surface 52 of a body of water 54 within chamber 18, FIG. 6. Insert 48 also includes a passageway 56 that may receive a cap 58, FIG. 4, or a cup containing herbal material that may be ignited. It should be noted that cap 58, as well as lid 50, may be formed with known "child-proof" characteristics.

Figure 7:
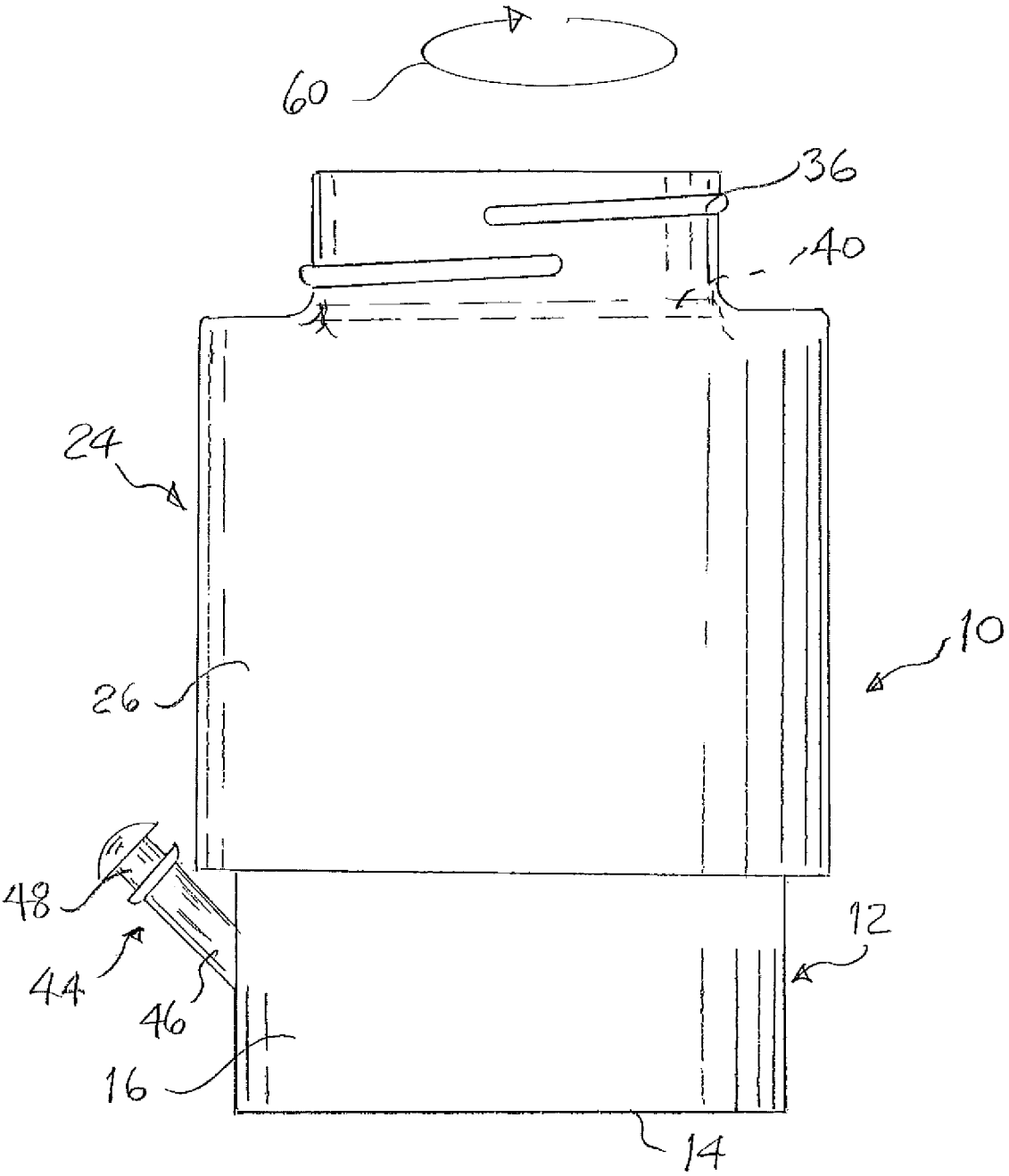
FIG. 7 is a side-elevational view of the jar device of the present application in its storage configuration.
Figure 8:
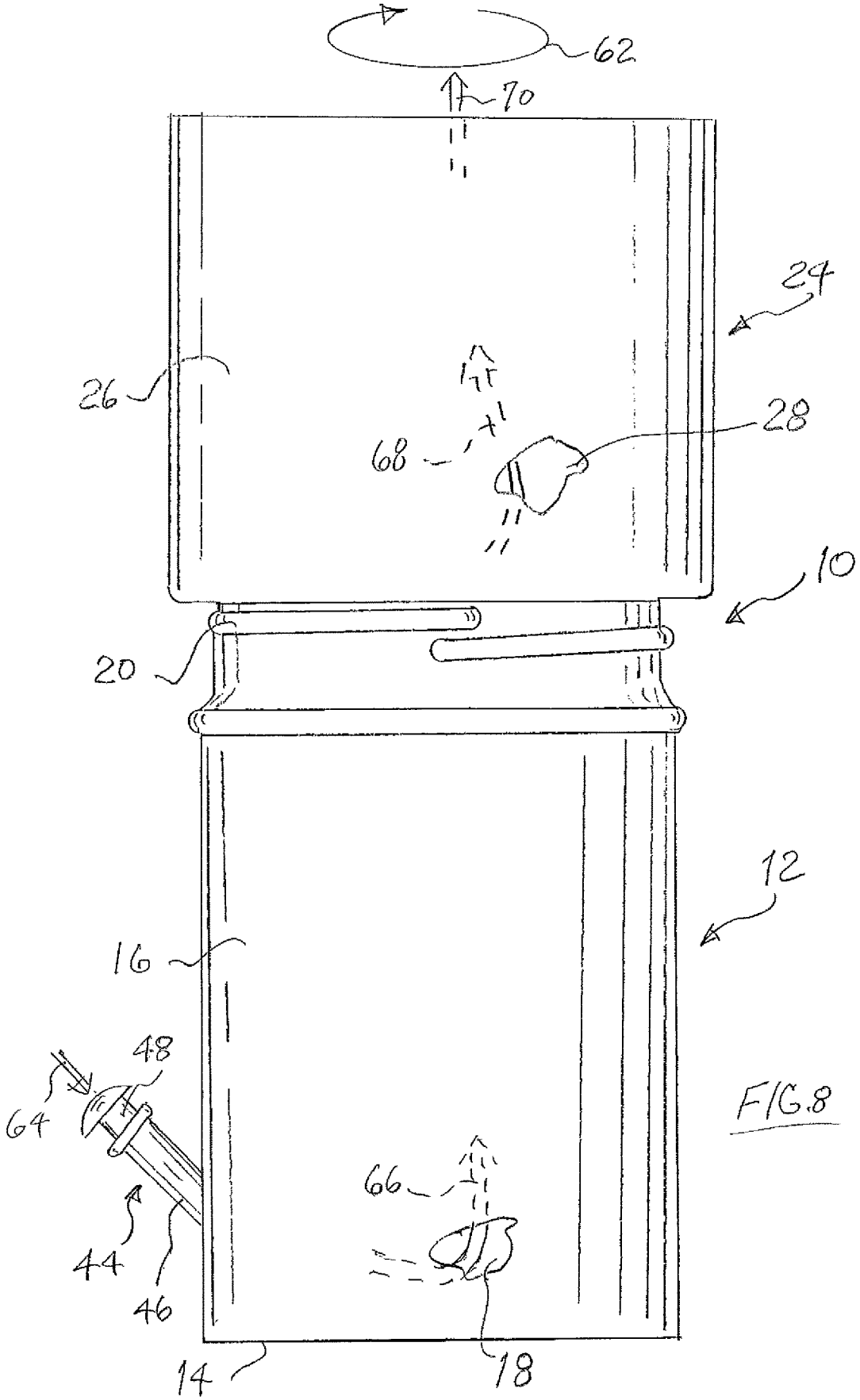
FIG. 8 is a side-elevational view of the jar device of the present application in its water pipe configuration.

In operation, with particular reference to FIGS. 7 and 8, jar device 10 is configured to its storage position by placement of hollow body 24 over container 12, FIG. 7, and the threading engagement of first threaded surface 20 of container 12 with second threaded surface 38 of hollow body 24. Such maneuver is achieved via the twisting or turning indicated by directional arrow 60. At this point, lid 40 would lie atop upper surface 42 of wall 16 adjacent mouth 17 of container 12. Thus, jar device 10 is now in a compact configuration. Also, untwisting and removing hollow body 24 from container 12 and turning hollow body 24 upside down from that shown in FIG. 7 allows hollow body 24 to assume the configuration of FIG. 8. In such a configuration, first threaded surface 36 of hollow body 24 threadingly engages second threaded surface 22 of container 12 by twisting or turning according to directional arrow 62. Essentially, hollow body 24 is mated or connected to container 12 by this action. At this point, lid 40 has been removed from jar device 10 and placed aside. Consequently, smoke from herbal burning may extend through spout 44, specifically insert 48, through chamber 18, and into open chamber 28 where such smoke is accessible to a user adjacent open chamber 28, directional arrows 64, 66, 68, and 70, FIG. 8.

While in the foregoing embodiments of the application have been set forth in considerable detail for the purposes of making a complete disclosure of the invention, it may be apparent to those of skill in the art that numerous changes may be made in such details without departing from the spirit and principles of the invention.

What is claimed is:

1. A jar device, comprising:

a container, said container comprising a bottom and a wall extending therefrom and forming a chamber, said wall terminating in a mouth, said container further comprising a first threaded surface outside said chamber and a second threaded surface within said chamber, and an upper surface of said wall, said upper surface of said wall and said first and second threaded surfaces of said container being positioned immediately adjacent said container mouth;

a hollow body, said hollow body comprising a wall portion forming an open chamber, said wall portion further forming a first entryway to said open chamber and a second entryway to said open chamber, said hollow body further comprising a first threaded surface adjacent said first entryway to said open chamber, said first threaded surface of said hollow body lying outside said open chamber, and a second threaded surface adjacent said first entryway, said second threaded surface lying within said open chamber;

said first threaded surface of said container being capable of threadingly engaging said second threaded surface of said hollow body and said second threaded surface of said container being capable of threadingly engaging said first threaded surface of said hollow body; and a lid removably positioned to rest only atop said upper surface of said wall of said container only and said lid covering said mouth of said container only during said threading engagement of said second threaded surface of said hollow body with said first threaded surface of said container.

2. The jar device of claim 1 in which said first entryway to said open chamber of said hollow body possesses a smaller transverse dimension than the transverse dimension of said second entryway to said open chamber of said hollow body.

3. The jar device of claim 2 in which said container possesses a transverse dimension and said transverse dimension of said second entryway of said hollow body exceeds said transverse dimension of said container permitting at least a portion of said hollow body to overly said container wall when said second threaded surface of said hollow body threadingly engages said first threaded surface of said container.

4. The jar device of claim 3 in which said container and hollow body are formed of glass material.

5. The jar device of claim 4 in which said glass material comprises a translucent material.

6. The jar device of claim 1 which additionally comprises a spout communicating with said chamber of said container.

7. The jar device of claim 6 in which said first entryway to said open chamber of said hollow body possesses a smaller transverse dimension than the transverse dimension of said second entryway to said open chamber of said hollow body.

8. The jar device of claim 7 in which said container possesses a transverse dimension and said transverse dimension of said second entryway of said hollow body exceeds said transverse dimension of said container permitting at least a portion of said hollow body to overly said container wall when said second threaded surface of said hollow body threadingly engages said first threaded surface of said container.

9. The jar device of claim 8 in which said container and hollow body are formed of glass material.

10. The jar device of claim 9 in which said glass material comprises a translucent material.

11. The jar device of claim 10 which additionally comprises a cap for said spout.

12. The jar device of claim 10 which additionally comprises a tubular insert for said spout.

* * * * *